US007195347B2

(12) United States Patent
Lee et al.

(10) Patent No.: US 7,195,347 B2
(45) Date of Patent: Mar. 27, 2007

(54) INK CARTRIDGE

(75) Inventors: Jae-cheol Lee, Suwon (KR); Young-su Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 173 days.

(21) Appl. No.: 10/731,005

(22) Filed: Dec. 10, 2003

(65) Prior Publication Data

US 2004/0125183 A1 Jul. 1, 2004

(30) Foreign Application Priority Data

Dec. 26, 2002 (KR) ..... 10-2002-0084580

(51) Int. Cl.
*B41J 2/175* (2006.01)
*B31B 1/60* (2006.01)

(52) U.S. Cl. ..... 347/87; 156/60

(58) Field of Classification Search ..... 347/84–87; 29/623.2, 623.4; 156/60
See application file for complete search history.

(56) References Cited

U.S. PATENT DOCUMENTS

| | | | | |
|---|---|---|---|---|
| 5,181,936 | A * | 1/1993 | Meadows | 29/623.2 |
| 5,409,134 | A * | 4/1995 | Cowger et al. | 222/1 |
| 6,182,072 | B1 | 1/2001 | Leak et al. | |
| 6,183,072 | B1 * | 2/2001 | Altendorf | 347/85 |
| 6,281,911 | B1 * | 8/2001 | Nakazawa et al. | 347/36 |
| 6,390,613 | B1 * | 5/2002 | Liu | 347/85 |
| 6,758,556 | B2 * | 7/2004 | Ishizawa et al. | 347/86 |

FOREIGN PATENT DOCUMENTS

JP 2002-120383 4/2002

OTHER PUBLICATIONS

Chinese Patent Office Action dated Nov. 4, 2005, corresponding application No. 200310118198.5.
Japanese Office Action issued Jan. 16, 2007, in Japanese Patent Application No. 2003-427160, which corresponds the above-identified, U.S. Appl. No. 10/731,005.

* cited by examiner

*Primary Examiner*—Anh T. N. Vo
(74) *Attorney, Agent, or Firm*—Staas & Halsey LLP

(57) ABSTRACT

A cartridge body partitioned into foam chambers and ink chambers and having a first welding part and a second welding part, a lid having a third welding part engaged and welded with the first welding part of the cartridge body and a fourth welding part formed on the bottom thereof in which the second welding part is inserted. Ink heads provided on the bottom of the cartridge body eject ink, and ink filters provided on upper sides of the ink heads to prevent foreign materials or bubbles from flowing in. The first welding part has a first section horizontally protruded in cross-section and a second section vertically protruded to the first section, and the third welding part has a third section vertically protruded, a fourth section horizontally protruded, and a fifth section in a diagonal cross-sectioned shape connecting the third section and the fourth section. The second welding part has a vertical rectangular shape in cross-section, and the fourth welding part has a concave groove formed in which the second welding part is inserted.

22 Claims, 9 Drawing Sheets

INK CARTRIDGE

CROSS-REFERENCE TO RELATED APPLICATION

This application claims the benefit of Korean Patent Application No. 2002-84580, filed on Dec. 26, 2002, in the Korean Intellectual Property Office, the disclosure of which is incorporated herein by reference.

BACKGROUND OF THE INVENTION

1. Field of the Invention

The present invention relates to an ink cartridge, and more particularly, to an ink cartridge for an image forming apparatus wherein a cartridge body and a lid are more precisely welded to each other to avoid ink blending in the cartridge, assure generation and maintenance of a proper negative pressure inside the cartridge, and reduce manufacturing defects.

2. Description of the Related Art

In general, an ink cartridge, capable of supplying ink upon printing, is employed for an inkjet printer and the like. A conventional ink cartridge is mainly divided into a cartridge body, holding ink and provided with ink filters and ink heads, and a lid. The cartridge body and the lid have welding parts for welding the parts together.

FIG. 1 and FIG. 2 are a cross-sectional view and a plan view showing a conventional cartridge body 102 capable of holding three color inks, respectively. The cartridge body 102, as can be seen in FIGS. 1 and 2, includes foam chambers 106, ink chambers 108, first to third partitions 110, 112, and 113 partitioning respective color inks as well as the foam chambers 106, the ink chambers 108, ink filters 115, and ink heads 117.

The foam chambers 106 have foams 107 therein, and the foams 107 create a negative pressure inside the foam chambers 106. The ink filters 115 are mounted underneath the foam chambers 106, and remove foreign materials or contaminants that may be contained in ink. The paths through which respective color ink flows are formed under the ink filters 115, and on the ends mounted the ink heads 117. The ink heads 117 eject proper amounts of ink when printing so that printing can be done.

Ink is kept in the ink chambers 108 that are partitioned from the foam chambers 106 by the first partition 110. Further, the ink chambers 108 connect with the foam chambers 106 by way of link openings 111 formed at the bottom of the first partition 110.

Such ink chambers 108 and foam chambers 106, as shown in FIG. 2, are partitioned from each other for respective color inks. Separate ink filters 115 and ink heads 117 under the foam chambers 106 are used for respective color inks.

The cartridge body 102 structured as above is bonded to a lid 104 shown in FIG. 3 and FIG. 4 to seal the foam chambers 106 and the ink chambers 108 for the respective color inks. For the cartridge body 102 shown in FIG. 1 and FIG. 2, the first welding part 122 (shown in FIG. 1) formed on the top rim surface of the cartridge body 102 and the second welding part 124 (shown in FIG. 1) formed on the top surfaces of the first to third partitions are ultrasonically welded with the third welding part 126 and, the fourth welding part 128 which are formed on the lid 104.

FIG. 3 is a bottom view of the lid 104 covering the upper side of the cartridge body 102 having ink injection holes 119 and 120 through which ink can be injected into respective chambers. The third welding part 126 welded with the first welding part 122 (shown in FIG. 1) is shown as a one-dot chain line, and the third welding part 128 welded with the second welding part 124 is shown as a two-dot chain line. FIG. 4 is a view for showing the upper side of the lid 104, wherein it can be seen that the ink injection holes 119 and 120 are formed for the foam chambers 106 and ink chambers 108 respectively for respective color inks.

In general, when an ink cartridge is manufactured, the lid 104 is placed on the upper side of the cartridge body 102, the horn of an ultrasonic welder (not shown) is closely contacted on, and pressed, against the lid 104, and vertically vibrates at a frequency of about 20 KHz in a certain amplitude. With such vibration, high heat is generated on the friction surfaces, that is, the first to fourth welding parts 122, 124, 126, and 128 between the cartridge body 102 and the lid 104, so that the first welding part 122 is welded with the third welding part 126, and the second welding part 124 is welded with the fourth part 128.

The first welding part 122, as shown in enlarged views of FIG. 1 and FIG. 3, has a triangular shape tilted to one side, and contacts the third welding part 126 which has a flat surface. Further, the second welding part 124 has a triangular shape, and is welded with the fourth welding part 128 which has a flat surface.

Accordingly, when sealing the conventional ink cartridge by ultrasonic welding, the cartridge body 102 and the lid 104 may slide against each other due to the vibration since the ultrasonic welder (not shown) generates vibration while pressed to the lid 104 placed on the cartridge body 102.

Further, since the first to third partitions 110, 112, and 113, partitioning the chambers of the cartridge body 102, are relatively thin in thickness in relation to their length, the first to third partitions 110, 112, and 113 may move to the left and right due to instant pressure and vibration generated when the ultrasonic welder is pressed against them. Vibration energy is likely to be scattered, rather than being concentrated on the welding portions, due to bends of the partitions 110, 112, and 113. With such phenomena, the first to fourth welding parts 122, 124, 126, and 128 may partially have portions not melted, which leads to imperfect sealing.

In general, in operation of an ink cartridge, ink is injected into respective chambers through the ink injection holes 119 and 120, and ink injection holes 120, for ink injection into the ink chambers 108. are sealed during use. Ink is used through the ink heads 117 during printing, and, when the level of ink is lowered, ink, kept in the ink chamber 108, is supplied to the foam chamber 106 through the link opening 111 formed at the bottom of the first partition 110, so a negative pressure of the ink chamber 108 increases.

If the level of ink in the foam chamber 106 is gradually lowered, air externally flows into the foam chamber 106 through the ink injection holes 119 due to the negative pressure of the ink chamber 108. The airflow in forms air bubbles (not shown), and the air bubbles flow into the ink chamber 108 through the link opening 111. With such series of operations continuously repeated, the ink of the ink chamber 108 is consumed so that all the ink can be used up to the last ink remaining in the foam chamber 106.

In order to ideally use ink as above, it is essential to generate a proper negative pressure in the ink chamber 108. To generate the proper negative pressure, secure sealing, between exterior and interior air, has to be maintained by the sealing between the first welding part 122 and the third welding part 126 and between the second welding part 124 and the fourth welding part 128.

However, since the conventional ink cartridge has the first and second welding parts. 122 and 124 of the cartridge body 102 formed in a triangular shape, and also has the third and fourth welding parts 126 and 128 of the lid 104 formed in a flat shape, the parts slide against each other and vibration energy transfers are not sufficient between the parts during the ultrasonic welding. Due to such phenomena, welding is only partially carried out so that sealing between the cartridge body 102 and the lid 104 is not implemented preventing a negative pressure from being generated in the ink chamber 108 and causing a phenomenon of ink flowing down out of the ink head 117 due to gravity.

Further, in a case of non-welded portions on the second and fourth welding parts 124 and 128, respective color inks are blended together that should be separated by the second partition 112 and the third partition 113, to further degrade printing quality.

SUMMARY OF THE INVENTION

The present invention has been devised to solve the above and/or other problems, so it is an aspect of the present invention to provide an ink cartridge having less movement during ultrasonic welding of a cartridge body and a lid so the cartridge body and the lid can be effectively welded.

According to an aspect of the present invention, an ink cartridge includes a cartridge body partitioned into foam chambers and ink chambers, having a first welding part and a second welding part, a lid having a third welding part engaged and weldable with the first welding part of the cartridge body, and a fourth welding part formed on the bottom thereof in which the second welding part is insertable. Ink heads provided on the bottom of the cartridge body eject ink, and ink filters provided on upper sides of the ink heads prevent foreign materials or bubbles from flowing in.

The first welding part has a first section horizontally protruded in cross-section and a second section vertically protruded to the first section, and the third welding part has a third section vertically protruded, a fourth section horizontally protruded, and a fifth section in a diagonal cross-sectional shape connecting the third section and the fourth section. The first section has a concave groove formed on the upper end portion thereof, and an angle between a boundary line and a vertical line of the fifth section ranges from substantially 20 to 70 degrees.

According to an aspect of the present invention, the cartridge body holds one or more color inks, and includes one or more partitions partitioning different color inks. The upper end portions of the second welding part may be formed in a convex shape, or formed in a concave shape.

According to an aspect of the present invention, the second welding part has a vertical rectangular shape in cross-section, and the fourth welding part each has a concave groove formed in which the second welding part is insertable. The upper sides of the grooves are each formed in a symmetrical triangle in cross-section, and an angle between extension lines from two symmetric faces of the symmetric triangle ranges from substantially 30 to 150 degrees. The second welding part has a thickness less than a width of each of the grooves formed in the fourth welding part, so that predetermined spaces occur on both sides of each second welding part when the second welding part is inserted in the fourth welding part, and the spaces are substantially equal to or less than 0.4 mm each.

According to an aspect of the invention, an ink cartridge includes a cartridge body partitioned into foam chambers and ink chambers, and a first welding part along the upper rim portion thereof and a second welding part having second concave grooves formed on upper end portions of partitions, a lid having a third welding part engageable and weldable with the first welding part of the cartridge body and a fourth welding parts formed on the bottom thereof in which the second welding part is insertable. Ink heads on the bottom of the cartridge body eject ink, and ink filters on upper sides of the ink heads prevent foreign materials or bubbles from flowing in.

The grooves of the second welding part may each have a rectangular shape in cross-section, and the fourth welding part may have a triangular shape in cross-section, or a cross-section combining the rectangular and triangular shapes. The cartridge body may hold one or more color inks, and include plural partitions partitioning different color inks.

Additional aspects and advantages of the invention will be set forth in part in the description which follows and, in part, will be obvious from the description, or may be learned by practice of the invention.

BRIEF DESCRIPTION OF THE DRAWINGS

These features and/or other aspects and advantages of the invention will become apparent and more readily appreciated from the following description of the embodiments taken in conjunction with accompanying drawings in which:

FIG. 7 to FIG. 9 are views showing a lid 15 according to an embodiment of the present invention, wherein FIG. 7 is a bottom view of the lid 15, FIG. 8 is a side view viewed in an arrow direction X of FIG. 7, and FIG. 9 is a cross-sectional view taken along lines VIII—VIII and viewed in a direction Y;

DETAILED DESCRIPTION OF THE INVENTION

Figure 1:
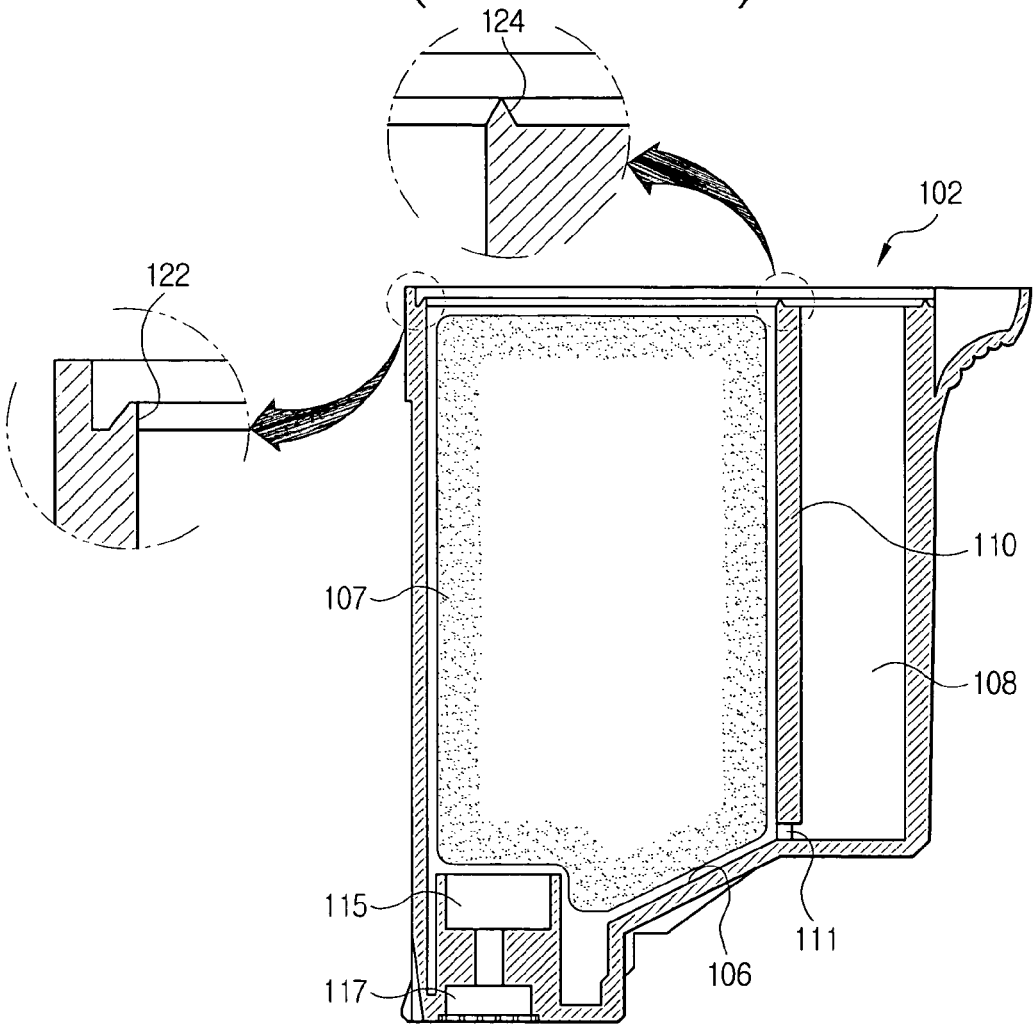
FIG. 1 (PRIOR ART)
FIG. 1 is a cross-sectional view showing a conventional cartridge body for an ink cartridge holding three color inks.
Figure 2:
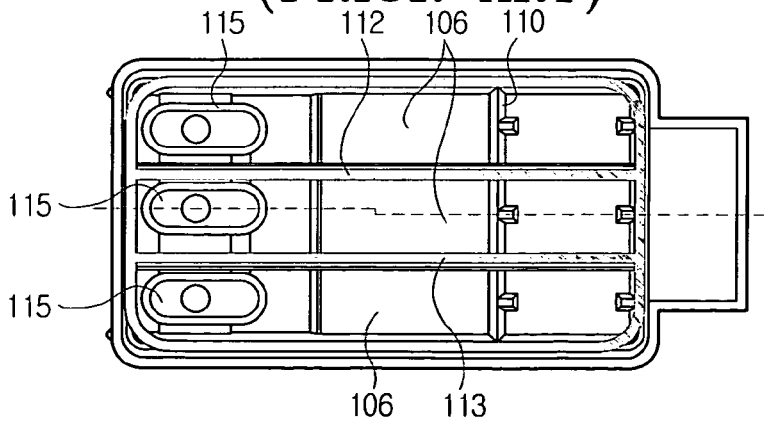
FIG. 2 (PRIOR ART)
FIG. 2 is a plan view showing the conventional cartridge body for an ink cartridge shown in FIG. 1.
Figure 3:
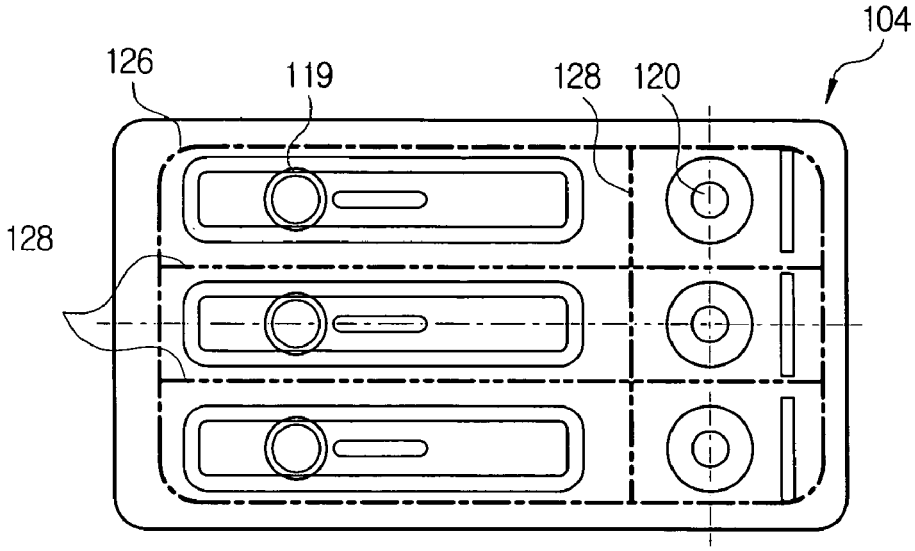
FIG.3 (PRIOR ART)
FIG. 3 is a bottom view showing a conventional lid coupled with the cartridge body shown in FIG. 1.
Figure 4:
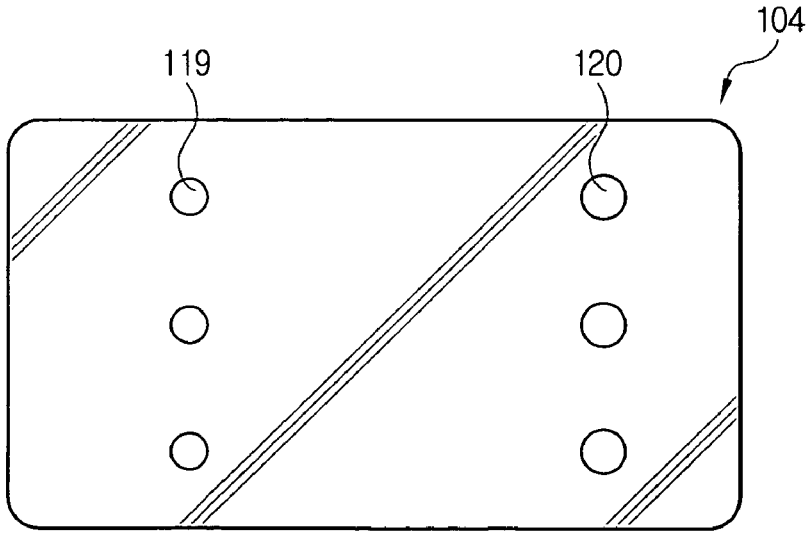
FIG.4 (PRIOR ART)
FIG. 4 is a plan view showing the conventional lid shown in FIG. 3.

Reference will now be made in detail to the embodiments of the present invention, examples of which are illustrated in the accompanying drawings wherein like reference numerals refer to the like elements throughout. The embodiments are described below in order to explain the present invention by referring to the figures.

FIG. 5 to FIG. 9 are views showing an ink cartridge according to an embodiment of the present invention. As shown in FIGS. 5 to 9, an ink cartridge of the present invention includes a cartridge body 13, a lid 15, ink heads 33, and ink filters 31.

Figure 5:
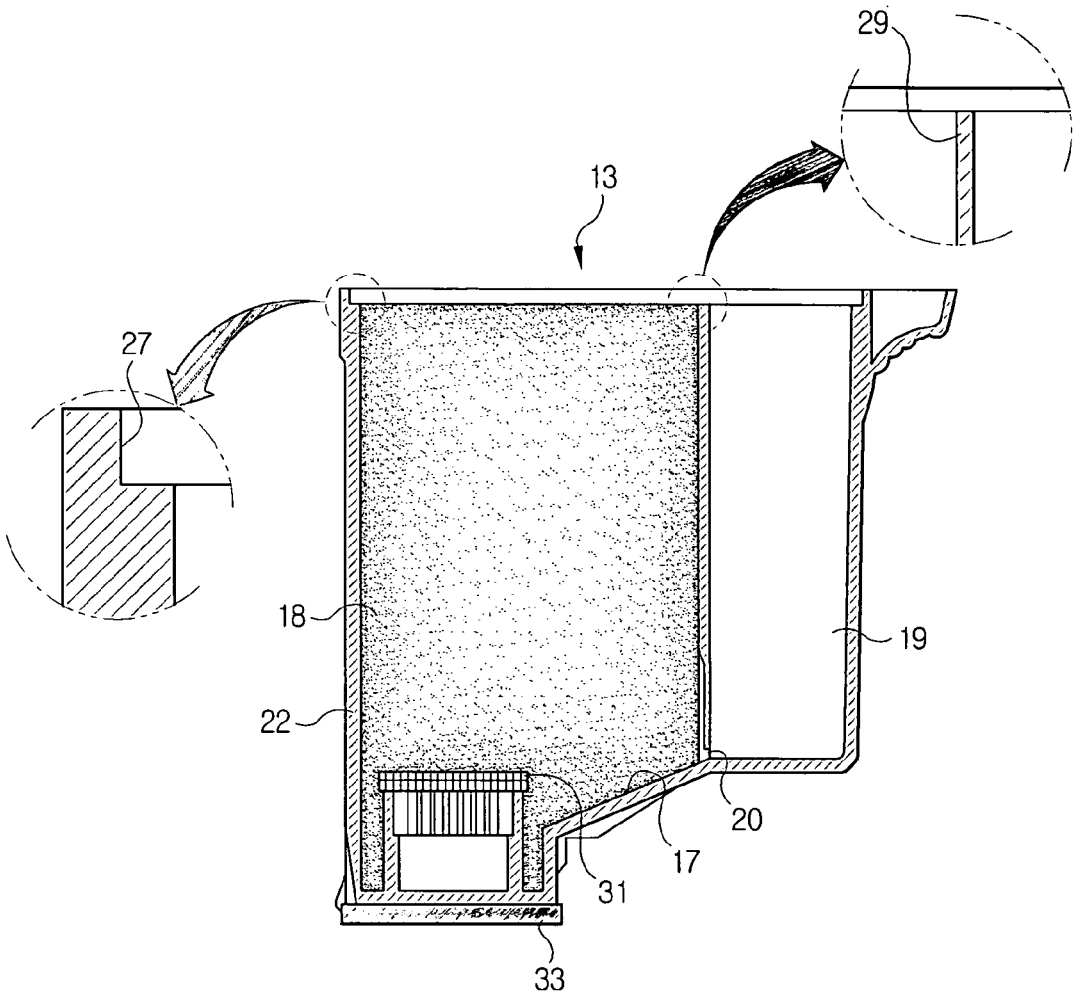
FIG. 5 is a view showing an ink cartridge according to an embodiment of the present invention, together with a cross-sectional view of a cartridge body viewed at a side thereof, and a cross-sectional view showing enlarged first and second welded parts.
Figure 6:
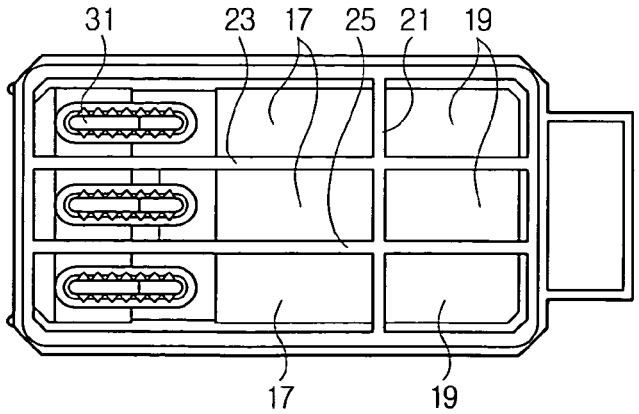
FIG. 6 is a plan view showing the cartridge body shown in FIG. 5.

The cartridge body 13, as can be seen from a cross-sectioned view of FIG. 5 and a plan view of FIG. 6, has its interior space partitioned into foam chambers 17 and ink chambers 19 for respective color inks by a first partition 21, a second partition 23, and a third partition 25.

The ink filters 31 and the ink heads 33 are provided on the bottom of the foam chambers 17, and foams 18 are provided inside the foam chambers 17. The ink chambers 19 are a place to store ink, and connect with the foam chambers 17 by link openings 20 formed at the bottom of the first partition 21. Ink and air flow in, and out, through respective link openings 20.

As enlarged and shown in FIG. 5, a cross-section view of a first welded part 27 on the upper side of a rim 22 of the cartridge body 13 is shown, and a second welded part 29 is formed on the upper side of the first to third partitions 21, 23, and 25.

Figure 7:
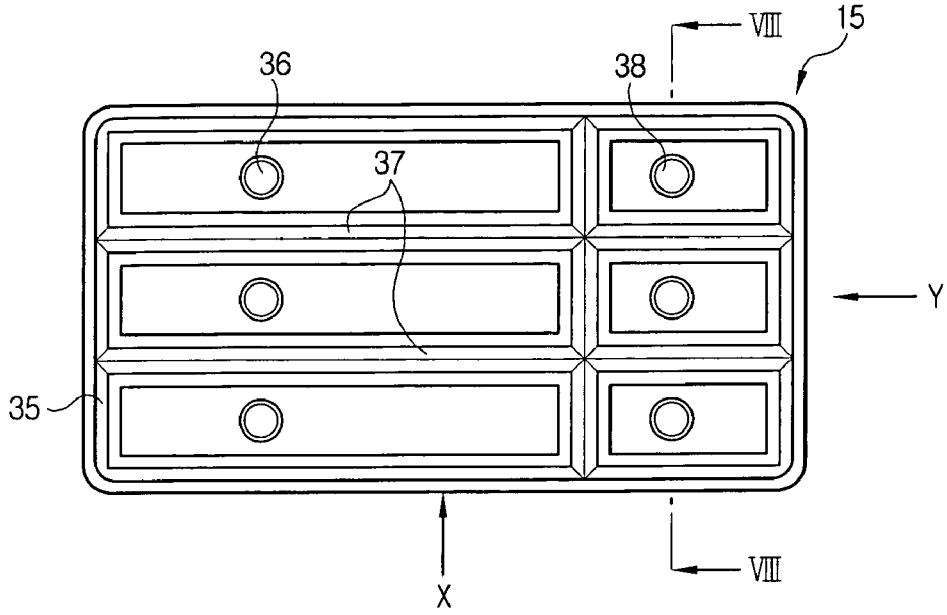
Figure 8:
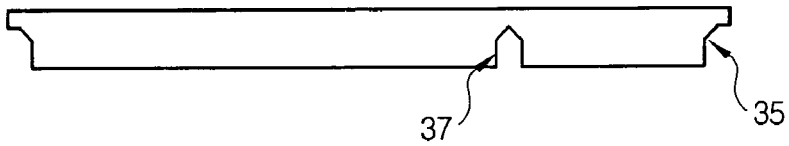
Figure 9:
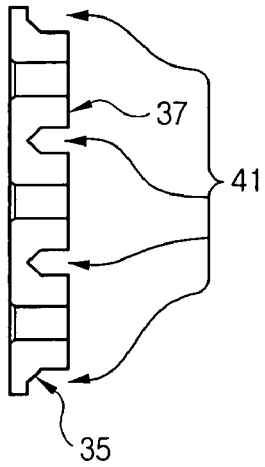

FIG. 7 to FIG. 9 are views showing the lid 15 according to an embodiment of the present invention, wherein FIG. 7 is a bottom view of the lid 15, FIG. 8 is a side view viewed in an arrow direction X of FIG. 7, and FIG. 9 is a cross-sectioned view taken along lines VIII—VIII and viewed in a direction Y.

On the lid 15 are ink injection holes 36 and 38 through which ink can be injected to the foam chambers 17 and the ink chambers 19 color by color, and on the bottom of the lid 15 is a third welded part 35 weldable with the first welded part 27 and a fourth welded part 37 weldable with the second welded part 29. The fourth welded part 37 has a plurality of grooves 41 shown in FIG. 9 where the second welding part 29 is inserted.

Figure 10:
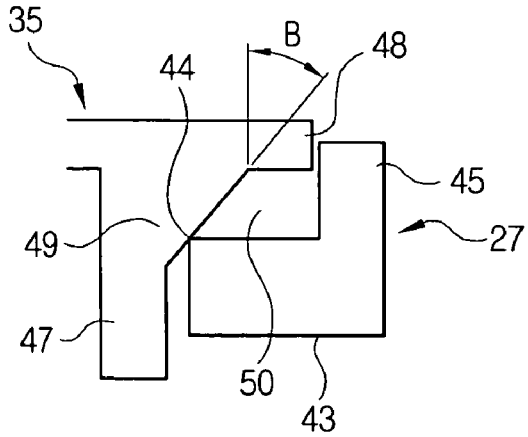
FIG. 10 is a view showing an ink cartridge according to an embodiment of the present invention, enlarging the welding relations between a first welded part formed on the upper side of a cartridge body and a third welded part formed on the bottom of the lid.
Figure 11:
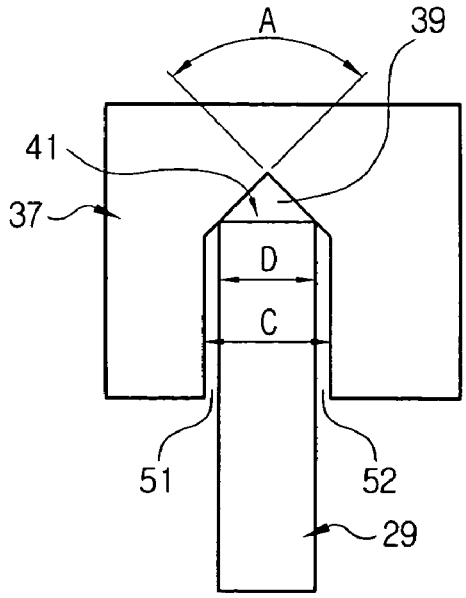
FIG. 11 is a view showing an ink cartridge according to an embodiment of the present invention, enlarging the welding relations between second welded parts formed on the upper sides of first to third partitions and the fourth welded part formed on the bottom of the lid.

FIG. 10 is a view showing an ink cartridge according to an embodiment of the present invention, enlarging the first welded part formed on the upper side of the cartridge body 13 that is engageable and weldable with the third welded part 35 of the lid 15. FIG. 11 is an enlarged view of the second welding part 29 formed on the upper sides of the first to third partitions 21, 23, and 25 of the cartridge body 13 insertable into, and weldable with the fourth welded part 37 of the lid 15.

As can be seen in FIG. 10, the cross-section area of the first welded part 27 includes a first section 43 and a second section 45. The first section 43 is horizontally protruded, and the second section 45 has a vertically protruded cross-sectional shape.

The third welded part 35 can be divided into a third section 47, a fourth section 48, and a fifth section 49. The third section 47 is vertically protruded, the fourth section 48 is horizontally protruded, and the fifth section 49 is formed in a diagonal cross-sectional shape connecting the third section 47 and the fourth section 48. Further, in the cross-sectional view of FIG. 10, an angle B between an extension line of a boundary line between the second section 45 and the fifth section 49 and a vertical line of the fifth section 49 ranges substantially from 20 to 70 degrees.

The third welded part 35 is engageable with, pressed against, and vibration-welded with the first welded part 27 formed on the upper circumference of the cartridge body 13. That is, when the lid is placed on the cartridge body, as shown in FIG. 10, the corner portions of the fifth section 49 and the first section 43 come in contact.

In such a contact state, if an ultrasonic welder (not shown) generates vertical vibrations while pressing against the upper side of the lid 15 (refer to FIG. 7), the third welding part 35 on the bottom of the lid 15 vibrates in engagement with the first welding part 27 so that the contact portion 44 first melts down to weld the first and third welding parts 27 and 35, and an amount of melted-down resin flows into the space between the third welding part 35 and the first welding part 27 so that the first and third welding parts 27 and 35 are welded. The first section 43 of the first welding part 27 is welded with portions of the third and fifth sections 47 and 49 of the third welding part 35, and the second section 45 is welded with the remaining portions of the fourth and fifth sections 48 and 49, so that the first welding part 27 is sealed with the third welding part 35.

As can be seen in FIG. 11, the cross-sectional area of the second welding part 29 is formed in a rectangular shape. The second welding part 29 can have a thickness D smaller than a width C inside the groove 41 formed in the fourth welding part 37, which will be described later, formed in the lid 15. FIG. 11 is an enlarged view of the second welded part 29 inserted into a groove 41 of the fourth welded part 37. The plurality of grooves 41 are formed in the fourth welding part 37, as shown in FIG. 9.

The fourth welding part 37, out of the bottom of the lid 15, corresponds to the portions in contact with the upper ends of the first to third partitions 21, 23, and 25 of the cartridge body 13 (refer to FIG. 7), and, as can be seen in the enlarged view of FIG. 11, the groove 41 is formed.

The groove 41 has a cross-sectioned area of a substantially symmetrical triangular shape. Further, the groove 41 may have a cross-sectional concave shape or a non-symmetrical triangular shape. According to an aspect of the invention, the groove 41 is formed in the substantially symmetrical triangular shape, and an angle A formed by extension lines of two symmetrical faces of the symmetrical triangle ranges from 30 to 150 degrees. The second welding part 29 has the thickness D smaller than the width C inside the groove 41 of the fourth welding part 37 and a difference therebetween is formed equal to or less than 0.8 mm.

The welding relationship of the cartridge body and the lid for manufacturing an ink cartridge according to an aspect of the present invention structured as above are described. If the lid 15 (refer to FIG. 7) is mounted on the upper side of the cartridge body 13 (refer to FIG. 5), as shown in FIG. 10, the first welding part 27 is engaged with the third welding part 35. At the same time, as shown in FIG. 11, the second welding part 29 is inserted into the central portion of the respective groove 41 of the fourth welding part 37. FIG. 11 is an enlarged view of the fourth welding part 37. The fourth welding part 37 includes the plurality of grooves 41 for the insertion of each of the second welding parts 29 as shown in FIG. 9. By doing so, the front end corners of the second welding part 29 come in contact with the symmetrical faces of the symmetric triangular shape of the fourth welding part 37, so certain gaps 51 and 52 occur on the left and right sides of the second welding part 29 when inserted in the plurality of grooves 41. Each of the gaps 51 and 52 on the left and right sides of the second welding part 29 is equal to, or smaller, than 0.4 mm.

In such a state, if an ultrasonic welder (not shown) generates vertical vibrations while pressing against the upper side of the lid, the contact surfaces of the second welding part 29 and the fourth welding part 37 melt down, a portion of melted-down resin flows down into the left and right gaps 51 and 52, and a portion of remaining resin flows into space 39 on the upper side of the plurality of grooves 41 to weld the second and fourth welding parts 29 and 37. As a result, the left, right, and upper sides of the second welding part 29 are completely welded and fixed, so tight sealing can be accomplished.

The ink cartridge according to an aspect of the present invention formed as above is structured in a shape that the second welding part 29 is inserted inside the fourth welding part 37 and the first welding part 27 and the third welding part 35 are engaged with each other, so the lid 15 and the cartridge body 13 does not slide against each other and vibration energy is not scattered, even though vibration is applied by an ultrasonic welder (not shown) after the lid 15 is mounted to the cartridge body 13.

Further, rather than welding the upper end sides of the first to fourth welding parts 27, 29, 35, and 37, the three faces of the first welding part 27 and the third welding part 35 are adhered to one another, and the upper sides and the left and right sides of the second welding part 29 and the fourth welding part 37 are welded, so that secure sealing is accomplished.

Figure 12:
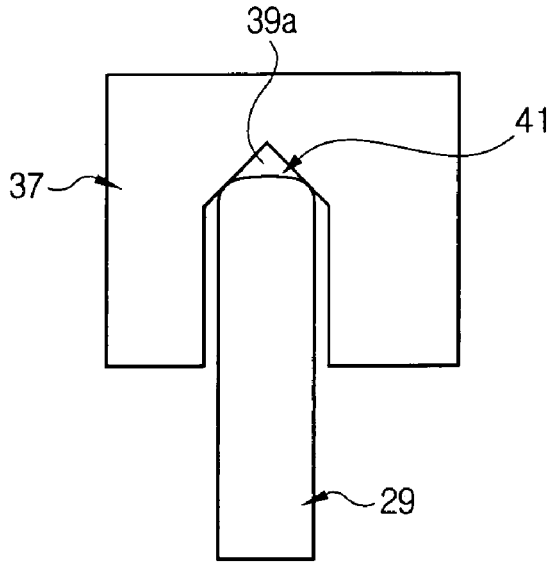
FIG. 12 and FIG. 13 are views showing an ink cartridge according to another embodiment of the present invention, cross-sectioning and enlarging the second welded part and the fourth welded part.

FIG. 12 is a view showing an ink cartridge according to another aspect of the present invention, enlarging the cross-section view of the second and fourth welding parts 29 and 37. As can be seen in FIG. 12, the upper side of the second welding part 29 is formed in a convex shape so upper space 39*a* of the groove 41 is reduced. The fourth welding part 37 formed on the bottom of the lid 15 has substantially the same shape as the above embodiment.

Figure 13:
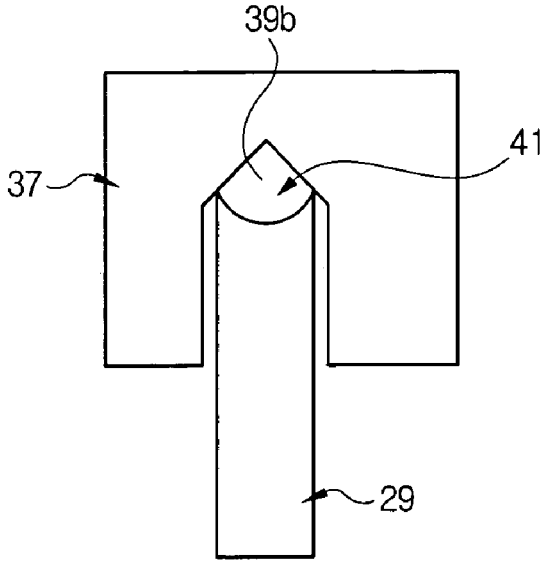

FIG. 13 is a view showing an ink cartridge according to yet another embodiment of the present invention, enlarging cross-sectional views of second and fourth welding parts 29 and 37. As can be seen in FIG. 13, the upper side of the second welding part 29 is convex so as to enlarge an upper space 39*b* of the groove 41. The fourth welding part 37 has the same shape as the above embodiment.

As such, the increase or decrease of the upper space 39 of the second welding part 29 enables an amount of resin flowing into the upper side of the second welding part 29 to be adjusted, or welding strength of the upper side of the same to be also adjusted.

Figure 14:
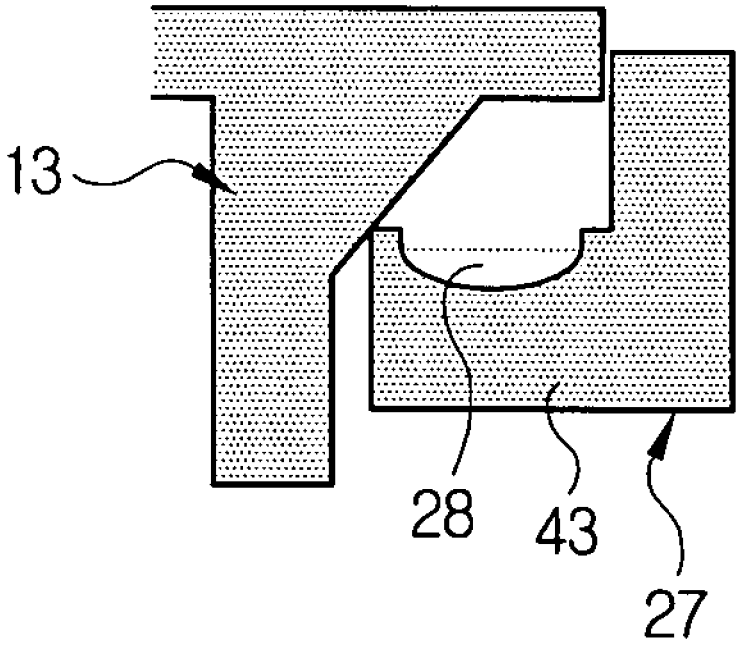
FIG. 14 is a view showing an ink cartridge according to yet another embodiment of the present invention, cross-sectioning and enlarging the first welded part and the third welded part.

FIG. 14 is a view showing an ink cartridge according to yet another aspect of the present invention, enlarging cross-sectional views of first and third welding parts 27 and 35. As can be seen in FIG. 14, a concave groove 28 is formed on the upper side of a first section 43 of the first welding part 27. The groove 28 increases space between the first welding part 27 and the third welding part 35 for more resin to flow in, to thereby improve the welding strength more.

Figure 15:
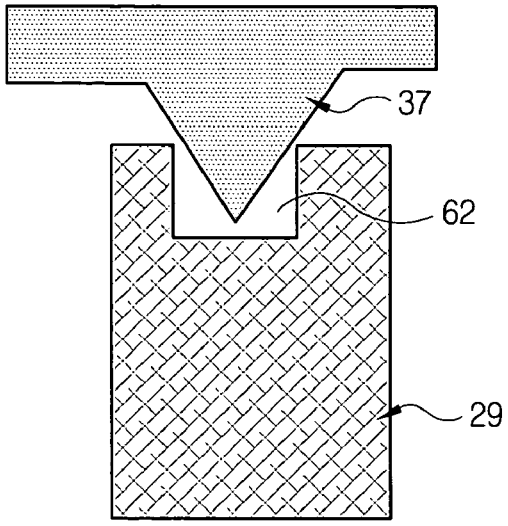
FIG. 15 to FIG. 17 are views showing ink cartridges according to other embodiments of the present invention, cross-sectioning and enlarging the second welded part and the fourth welded part.
Figure 16:
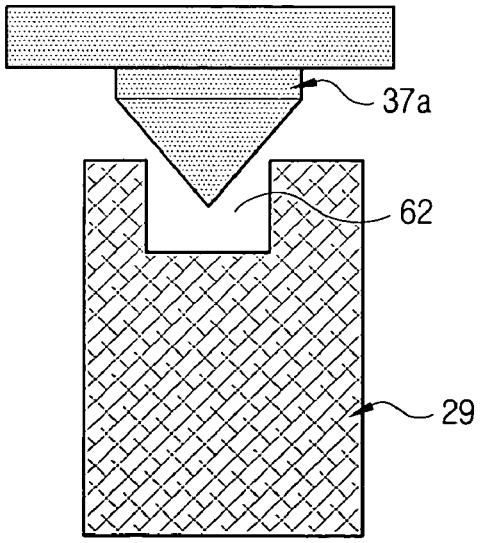
Figure 17:
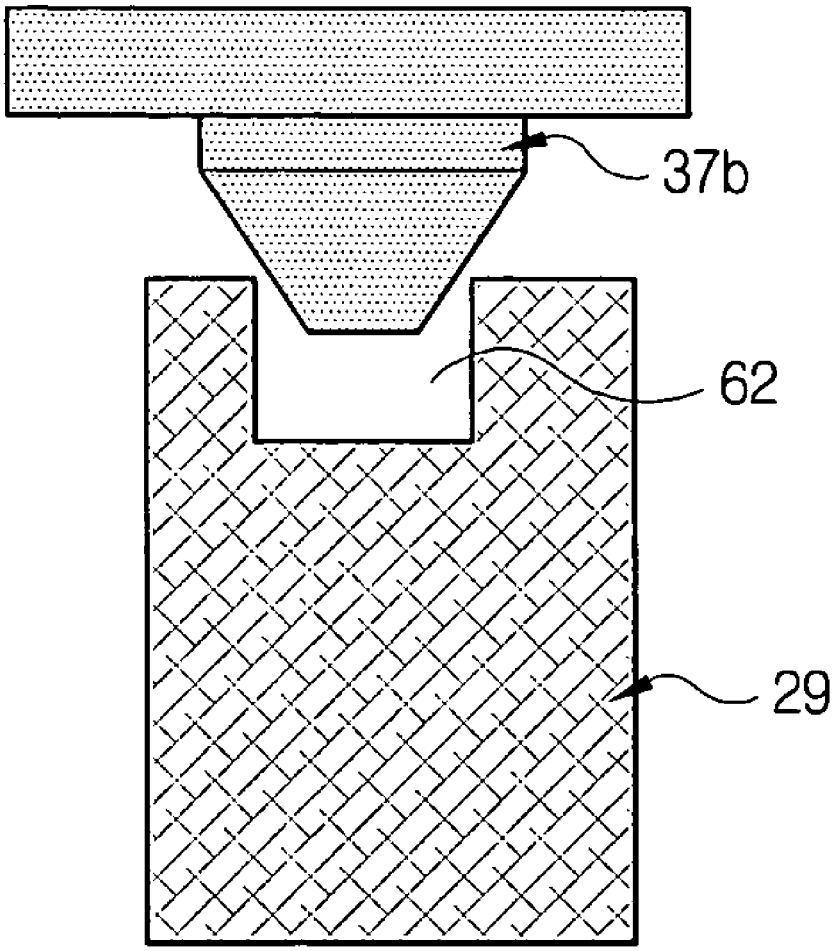

FIG. 15 to FIG. 17 are views showing ink cartridges according to other embodiments of the present invention, enlarging cross-sectional views of second and fourth welding parts 29 and 37. A groove 62 is formed on the upper side of the second welding part 29 formed on the upper sides of the first to third partitions 21, 23, and 25, and the fourth welding part 37 is protruded so as to be insertable in the groove 62.

The groove 62 has a rectangular shape, and the fourth welding part 37 may be formed in a triangular shape 37 as shown in FIG. 15, or in a cross-sectional shape 37*a* of a combination of triangular and rectangular shapes, as shown in FIG. 16. Further, as shown in FIG. 17, the fourth welding part 37 may be formed in an end portion-cut-off triangular shape 37*b* to expand an area coming in contact with the bottom of the groove 62 of the second welding part 29.

Welding relationships according to an aspect of the present invention are described as follows. If the lid 15 is mounted to the cartridge body 13 in order for the fourth welding part 37 to be inserted in the groove 62 of the upper side of the second welding part 29, the bottom of the fourth welding part 37 comes in contact with the bottom of the groove 62. In this state, when an ultrasonic welder (not shown) is used and vibration energy is transferred, the lid 15 and the cartridge body 13 do not slide against each other, and when contact surfaces melt, resin flows in spaces on both sides. With the contact surfaces melted, resin is stacked up in the groove 62, and the second welding part 29 and the fourth welding part 37 are firmly and fixedly welded.

The ink cartridge according to an aspect of the present invention has been described for a cartridge containing three colors of ink, but is not restricted to such and can be applied to all kinds of ink cartridges regardless of the number of color inks.

In the ink cartridge according to an aspect of the present invention structured as above, ink is injected through the ink injection holes 36 and 38, and the ink injection holes 38 for injecting ink into the ink chambers 19 are sealed by use of balls. The ink levels in the foam chambers 17 are lowered with ink used, and ink contained in the ink chambers 19 is supplied to the foam chambers 17 through the ink opening 20 formed at the bottom of the first partition 21.

If the ink levels in the foam chambers 17 are lowered, the negative pressure in the ink chambers 19 increases since the chambers 19 are substantially perfectly sealed from the exterior. Air is accordingly supplied from the foam chambers 17 to the ink chambers 19 so that the negative pressure increases, and air flows into the ink chambers 19 again so that ink is used through the foam chambers 17. Further, since the second welding part 29 on the upper sides of the second partition 23 and the third partition 25 is firmly welded and sealed with the fourth welding part 37 of the lid 15, there is little chance for different color inks to be mixed with one another.

The ink cartridge according to an aspect of the present invention as above has a structure so that the first welding part and the third welding part are engageable with each other on the upper side of the cartridge body, and either the second welding part or the fourth welding part is inserted into, and welded with the other, so that movements do not occur during the ultrasonic welding of the cartridge body and the lid and vibration energy is effectively transferred, to thereby improve a sealing effect between the cartridge body and the lid.

Although a few embodiments of the present invention have been particularly shown and described, it will be appreciated by those skilled in the art that changes may be made therein in these embodiments without departing from the principles and spirit of the invention, the scope of which is defined in the claims and their equivalents.

What is claimed is:

1. An ink cartridge, comprising:

a cartridge body, partitioned into foam chambers and ink chambers, and having a first welding part and a second welding part;

a lid having a third welding part, engageable and weldable with the first welding part of the cartridge body, and a fourth welding part on the bottom thereof in which the second welding part is insertable;

at least one ink head provided on the bottom of the cartridge body to eject ink; and at least one ink filter provided on an upper side of each ink head to prevent foreign materials or bubbles from flowing in, wherein the second welding part has a thickness less than a width of each of the grooves in the fourth welding part, so that a predetermined space occurs on both sides of each second welding part when the second welding part is inserted in the fourth welding parts, to define a first area, and a second area where the second welding part has continuous contact with the fourth welding part, and the first welding part has a first section horizontally protruded in cross-section and a second section vertically protruded to the first section, and the third welding part has a third section vertically protruded, a fourth section horizontally protruded, and a fifth section in a diagonal cross-sectional shape connecting the third section and the fourth section.

2. The ink cartridge as claimed in claim 1, wherein the first section has a concave groove on the upper end portion thereof.

3. The ink cartridge as claimed in claim 1, wherein an angle between a boundary line between the second section and the fifth section and a vertical line of the fifth section ranges from substantially 20 to 70 degrees.

4. The ink cartridge as claimed in claim 1, wherein the cartridge body holds one or more color inks, and further includes one or more partitions partitioning different color inks.

5. The ink cartridge as claimed in claim 1, wherein the upper end portions of the second welding part are a convex shape.

6. The ink cartridge as claimed in claim 1, wherein the upper end portions of the second welding part are a concave shape.

7. The ink cartridge as claimed in claim 1, wherein the second welding part has a vertical rectangular shape in cross-section, and the fourth welding part has a concave groove in which the second welding part is insertable.

8. The ink cartridge as claimed in claim 7, wherein the upper sides of the grooves are a symmetrical triangle in cross-section.

9. The ink cartridge as claimed in claim 8, wherein an angle between extension lines from two symmetric faces of the symmetric triangle ranges from substantially 30 to 150 degrees.

10. The ink cartridge as claimed in claim 1, wherein the predetermined spaces are substantially equal to, or less than, 0.4 mm each.

11. The ink cartridge according to claim 1, wherein the lid and the cartridge body do not substantially slide against each other when vibration is applied by an ultrasonic welder.

12. The ink cartridge according to claim 1, wherein a plurality of ink injection holes, for injecting ink into the ink chambers, are each sealed by a ball.

13. An ink cartridge, comprising:

a cartridge body, partitioned into foam chambers and ink chambers, and having a first welding part; and a lid having a second welding part, engageable and weldable with the first welding part, and wherein:

at least one of the first and second welding parts has at least one concave groove in which the other of the first and the second welding parts is insertable, the second welding part further comprises an upper side and a lower side, the first welding part horizontally displaced contacts the upper side of the second welding part in at least two contact sections, a predetermined space occurs between the first and second welding parts in a vertical direction, and an amount of resin flows in the predetermined space welding the first and second welding parts together.

14. The ink cartridge according to claim 13, wherein the predetermined space is substantially equal to, or less than, 0.4 mm.

15. The ink cartridge as claimed in claim 13, wherein the second welding part has a plurality of grooves, and the grooves of the second welding part each have a rectangular shape in cross-section.

16. The ink cartridge as claimed in claim 15, wherein the first welding part has a triangular shape in cross section.

17. The ink cartridge as claimed in claim 16, wherein the cartridge body has a cross section combining the rectangular and triangular shapes.

18. The ink cartridge according to claim 17, wherein the upper side of the second welding part has a convex shape, and the lower side has a rectangular shape.

19. The ink cartridge according to claim 17, wherein the upper side of the second welding part has a concave shape, and the lower side has a rectangular shape.

20. The ink cartridge as claimed in claim 13, wherein the cartridge body holds one or more color inks, and includes plural partitions partitioning different color inks.

21. The ink cartridge according to claim 13 wherein a plurality of ink injection holes are formed on the lid, for injecting ink into the ink chambers, are each sealed by a ball.

22. An ink cartridge, comprising:

a cartridge body having a first welding part and a second welding part; and a lid having a third welding part, engageable and weldable with the first welding part, and a fourth welding part on a lower side of the lid where the second welding part is insertable, wherein the first welding part has a first section horizontally protruded in cross-section and a second section vertically protruded to the first section, and the third welding part has a third section vertically protruded, a fourth section horizontally protruded, and a fifth section in a diagonal cross-sectional shape connecting the third section and the fourth section.

* * * * *